US005890442A

United States Patent [19]

Holmes et al.

[11] Patent Number: 5,890,442

[45] Date of Patent: Apr. 6, 1999

[54] GAS STABILIZED REBURNING FOR $NO_X$ CONTROL

[75] Inventors: Michael J. Holmes, Alliance; Clifford F. Eckhart, Damascus; Gregory A. Kudlac, Akron; Ralph T. Bailey, Uniontown, all of Ohio

[73] Assignee: McDermott Technology, Inc., New Orleans, La.

[21] Appl. No.: 589,987

[22] Filed: Jan. 23, 1996

[51] Int. Cl.[6] ..... F23C 1/10; F23B 7/00; F23J 11/00; F23D 11/10

[52] U.S. Cl. ..... 110/345; 110/261; 110/262; 110/238; 110/342; 239/423; 239/429

[58] Field of Search ..... 110/238, 260, 110/261, 262, 265, 342, 345; 239/423, 427, 429, 430

[56] References Cited

U.S. PATENT DOCUMENTS

| | | | |
|---|---|---|---|
| 411,555 | 9/1889 | Mason | 110/265 |
| 3,650,476 | 3/1972 | Rackley et al. | 239/431 |
| 3,877,400 | 4/1975 | Dingwell | 110/238 |
| 3,929,290 | 12/1975 | Tallarovic | 239/417.3 |
| 3,937,449 | 2/1976 | Copeland et al. | 266/29 |
| 4,160,526 | 7/1979 | Flanagan | 239/427 |
| 4,438,705 | 3/1984 | Basic, Sr. | 110/235 |
| 4,516,510 | 5/1985 | Basic, Jr. | 110/346 |
| 4,538,530 | 9/1985 | Whitman | 110/260 |
| 4,558,652 | 12/1985 | Downs et al. | 110/347 |
| 4,566,393 | 1/1986 | Connell et al. | 110/261 |
| 4,569,295 | 2/1986 | Skoog | 110/347 |
| 4,602,571 | 7/1986 | Chadshay | 110/264 |
| 4,606,722 | 8/1986 | Olauson | 432/14 |
| 4,779,545 | 10/1988 | Breen et al. | 110/212 |
| 4,803,932 | 2/1989 | Siwersson et al. | 110/260 |
| 4,819,878 | 4/1989 | Bailey et al. | 239/427 |
| 4,843,980 | 7/1989 | Markham et al. | 110/342 |
| 4,878,442 | 11/1989 | Yeh et al. | 110/345 |
| 4,899,670 | 2/1990 | Hansel | 110/264 |
| 4,960,059 | 10/1990 | Berkau et al. | 110/347 |
| 4,979,447 | 12/1990 | Farrar | 110/345 |
| 5,005,493 | 4/1991 | Gitman | 110/246 |
| 5,052,921 | 10/1991 | Hemsath | 432/121 |
| 5,078,064 | 1/1992 | Breen et al. | 110/212 |
| 5,129,583 | 7/1992 | Bailey et al. | 239/427 |
| 5,181,475 | 1/1993 | Breen et al. | 110/345 |
| 5,603,453 | 2/1997 | Weaver et al. | 239/8 |

*Primary Examiner*—Ira S. Lazarus
*Assistant Examiner*—Ljiljana V. Ciric
*Attorney, Agent, or Firm*—Daniel S. Kalka; Robert J. Edwards

[57] ABSTRACT

A coal-water slurry liquid fuel or coal or other liquid fuel is atomized for combustion in the reburn zone of a boiler with a relatively small addition of natural gas to produce $NO_x$ reductions comparable to the reburn effect of natural gas alone as well as a more uniform temperature profile in the upper combustion zone of the boiler.

10 Claims, 6 Drawing Sheets

GAS STABILIZED REBURNING FOR $NO_X$ CONTROL

BACKGROUND OF THE INVENTION

1. Field of the Invention

The present invention relates to an apparatus and method for reduction of nitrogen oxide emissions in flue gas using natural gas as a secondary reburn fuel when burning liquid fuels, such as coal water slurry or oil, or solid fuels, such as coal, as the primary fuel in the reburn combustion zone of a furnace.

2. Description of the Related Art

In the combustion of fuels with fixed nitrogen such as coal, oxygen from the air combines with the nitrogen to produce nitrogen oxides. At sufficiently high temperatures, oxygen reacts with atmospheric nitrogen to form nitrogen oxides. Nitrogen oxides are toxic and contribute to acid rain making the rain, dew and mist corrosive. Numerous government regulations limit the amount of nitrogen oxide which may be emitted from a combustion furnace and there is a need for apparatus and processes which reduce the nitrogen oxide emissions in furnace flue gas.

Numerous attempts have been made to develop apparatus and processes which reduce the nitrogen oxide emissions in a furnace flue gas. One such approach is a process known as in-furnace nitrogen oxide reduction, reburning, or fuel staging. In reburning pulverized coal, oil, gas, or other fuel is injected just downstream of a normal flame zone to form a fuel-rich reburning zone. Hence the nitrogen oxides are reduced to ammonia and cyanide-like fragments and $N_2$. Subsequently, air is injected to complete the combustion process. The reduced ammonia and cyanide-like fragments then react to form $N_2$ and nitrogen oxide.

Several problems are present with these prior art processes. First, coal is less efficient than natural gas as a reburn fuel because of its lower volatility and higher fixed-nitrogen composition. Within any furnace there are wide temperature zones in which fuel nitrogen will convert to nitrogen oxide. Thus, the fixed nitrogen reduced from the coal has a chance of ending up as nitrogen oxide.

Furthermore, the reburn fuel must be injected with a sufficient volume of air if air or flue gas containing oxygen is used as the carrier gas. There must be enough fuel to consume the oxygen in the carrier, and to supply an excess of fuel so reducing conditions exist. This increases the amount of fuel which must be used as reburn fuel. Furthermore, the necessity of using carrier air requires extensive duct work in the upper part of the furnace.

Additionally, the reburn fuel must be injected well above the primary combustion zone of the furnace so that it will not interfere with the reactions taking place therein. However, this fuel must be made to burn out completely without leaving a large amount of unburned carbon. To do this, the fuel must be injected in a very hot region of the furnace some distance from the furnace exit. The exit temperature of the furnace must be limited in order to preserve the heat exchanger surface. Therefore, a tall furnace is required to complete this second stage process.

Because of these mentioned problems with coal as a reburn fuel most of the reburn fuels used to date have been fluid fuels such as natural gas. The natural gas is injected into the reburn stage of the furnace in numerous ways.

In U.S. Pat. No. 4,779,545, a reburn process is disclosed wherein natural gas is introduced into the upper furnace through pulse combustors. The patent teaches that the natural gas must be injected in pulses to achieve $NO_x$ reduction. This process does not require any carrier air or flue gas for $NO_x$ reduction. However, it does require the expense of obtaining and operating pulse combustors and some air may be required. Therefore, there is a need for an improved process for in-furnace reduction of nitrogen oxides which can be implemented at low cost due to the fact that natural gas is an expensive fuel.

In U.S. Pat. No. 4,960,059 natural gas is injected along with pulverized coal into the primary combustion zone of the furnace to eliminate the need for reburn zone combustion. As an alternative the patent teaches that natural gas be used as the sole injected fuel in the reburn stage of the furnace. Thus this patent also fails to meet the need for implementing reburn combustion in a more economical manner which would use a less expensive fuel.

In U.S. Pat. No. 5,078,064 an apparatus and a process is disclosed wherein pipes, orifices, nozzles, diffusers, ceramic socks and porous ceramic bodies are employed to allow the natural gas reburn fuel to diffuse slowly into the flue gas. Although these techniques work they cannot be precisely controlled. Also since natural gas is used as the sole reburn fuel this patent also fails to provide a more economical reburn technique for $NO_x$ reduction.

In U.S. Pat. No. 5,181,475 there is provided an apparatus and process for the control of nitrogen oxide emissions in combustion products by injecting vortices of a combustible fluid into flue gas. Vortex ring generators introduce natural gas into combustion products in the reburn zone of the furnace as vortices which provide a thorough mix of natural gas and combustion products to eliminate excess air requirements. This process again has the same mentioned failings as all the other previously mentioned devices and techniques.

In view of the foregoing it is seen that an economical apparatus and fuel was needed to accomplish $NO_x$ reduction by reburn zone combustion.

SUMMARY OF THE INVENTION

The present invention solves the problems associated with prior art reburn apparatus and methodology as well as other problems and provides an enhanced reburn system for increased $NO_x$ removal.

This is done by co-firing coal, or known liquid fuels, such as coal water slurry or oil, with a small amount of natural gas to provide improved $NO_x$ removal and a more even temperature distribution in the furnace than is possible with the reburn zone combustion of the coal or known liquid fuels by themselves.

In the case of coal reburning, the natural gas is introduced into the reburn zone of the furnace via the reburner's primary air/coal pipe, or through a separate feed system. In the case of coal water slurry (CWS) reburning, the natural gas is introduced with the reburner's combustion air, through the slurry atomizer, or through a separate feed system. Best performance in terms of $NO_x$ removal is achieved when the natural gas is introduced through the slurry atomizer. Once in the furnace, the natural gas acts to release heat and aid in stabilizing coal combustion near the reburning burner by reacting with available oxygen to minimize oxidation of fuel-bound nitrogen in the coal. This results in lower total $NO_x$ at the stack and a more uniform heat release in the middle and upper furnace zones.

Thus it will be seen that one aspect of the present invention is to provide improved $NO_x$ reduction over coal/CWS reburning by co-firing a relatively small portion of natural gas in the reburn zone with the coal/CWS fuel to achieve NO. reductions in-line with those obtained using only natural gas reburn.

Another aspect of the present invention is to provide more uniform furnace temperatures than are possible with primary reburn fuel alone, when natural gas is used as a secondary reburn fuel to supplement the primary reburn fuel.

These and other aspects of the present invention will be more clearly understood after a review of the following description of the preferred embodiment when considered in conjunction with the accompanying drawings.

DESCRIPTION OF THE PREFERRED EMBODIMENT

Figure 1:
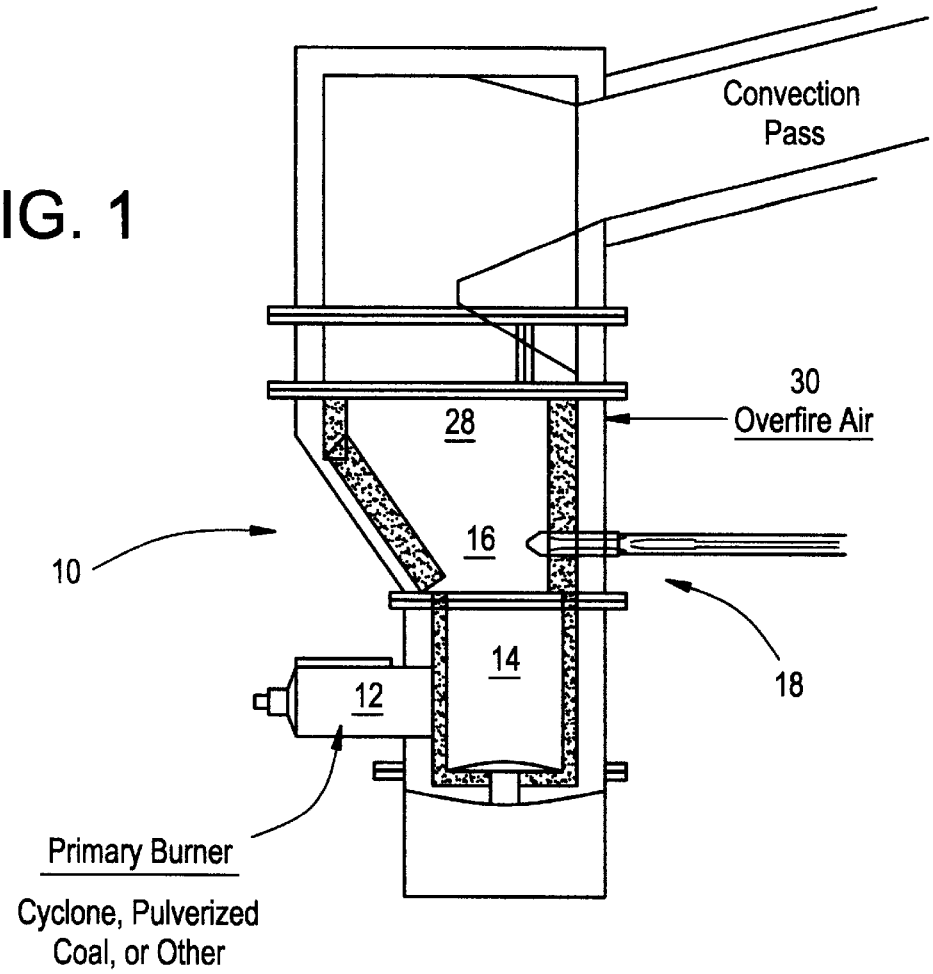
FIG. 1 is a schematic representation of a boiler flue showing coal-water slurry co-firing with natural gas in the reburn zone of the boiler.

Turning to FIG. 1, it will be seen that a boiler combustion configuration 10 is shown having a primary fuel burner for firing fuel such as pulverized coal, oil, or a coal-water slurry. This is the normal combustion zone 14 which produces $NO_x$ as was discussed in the related art description. Directly above this primary combustion zone is the reburn zone 16 where $NO_x$ is reduced by additional firing of injected fuels such as coal, oil, or a coal-water slurry in a known manner.

The Applicants have found that the reburning process is enhanced and $NO_x$ reductions increased by the addition of natural gas to coal or liquid fuels normally burned in the reburn zone 16 including coal water slurry. The best performance was obtained with the natural gas injected into an atomizer assembly 18 (versus other locations tried) and that atomization of liquid fuel using natural gas was technically feasible.

Introducing the natural gas in this manner provided more advantages when firing coal water fuel or oil in the reburn zone. The invention replaces compressed air or steam normally used for spraying liquid fuels in the reburn zone 16 with natural gas in the atomizer 18. Natural gas is used at typical line pressures of 60 psig or greater and supplies the momentum needed to atomize the liquid fuel. The momentum supplied by the compressed natural gas also will provide the energy needed to intimately mix the natural gas and the reburn fuel in order to maximize the benefits associated with this technology. The gas enhances combustion of reburn fuels while also eliminating the costs associated with the use of atomizing air or steam.

The operating parameters for atomization of the liquid fuel with natural gas vary depending on the application. The key variables in the atomizer 18 include natural gas-to-primary fuel (NG-to-PF) ratio in lb/lb, and natural gas pressure at the atomizer. Both of these variables represent the energy available for atomization of the primary fuel and for mixing of the two fuels and the combustion gases in the furnace. Typical operation in regards to atomization call for natural gas pressures between 45 and 120 psig, and NG-to-PF ratios from 0.05 to 0.5 lb/lb. Atomization and mixing will improve as both natural gas flow and pressure increase and therefore values beyond these listed as typical would be acceptable. Lower values also may be acceptable, but at some lower limits a second medium such as steam or compressed air may also be required to assist in the atomization.

Note that these ranges also depend on the properties of the primary fuel (e.g. heating value and viscosity), and the properties of the furnace. In many cases the NG-to-PF ratio is governed more by the optimum fuel split for reburning or other factors rather than by atomization requirements.

Figure 2A:
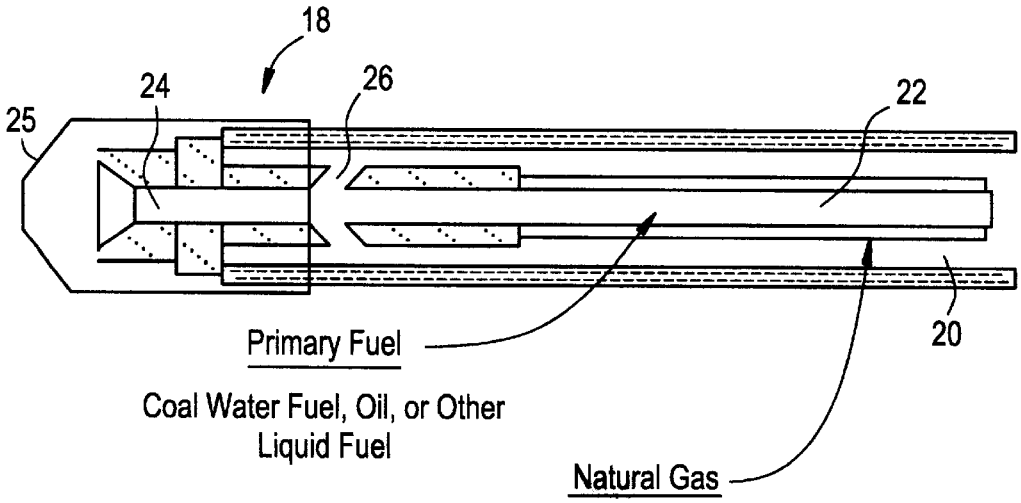
FIG. 2A is an expanded cut away side view of the co-firing atomizer for liquid fuels shown in the reburn zone of FIG. 1.

With particular reference to FIG. 2A, it will be noted that while the natural gas could be introduced into the reburn zone 16 of the furnace 10 around the slurry atomizer 18, with the reburner combustion air 30, or through a separate feed system, in the case of coal water slurry (CWS) reburning, the natural gas is introduced through an annulus 20 in the slurry atomizer 18. Feasibility tests showed the best performance in terms of $NO_x$ removal occurred when the natural gas was introduced through the slurry atomizer 18. Once in the furnace reburn zone 16 the natural gas, having a high reaction rate, acts to release heat and, therefore, aid in stabilizing coal combustion near the reburning burner 18 and preferentially react with available oxygen to minimize oxidation of fuel-bound nitrogen in the coal. The result is lower total $NO_x$ at the stack and a more uniform heat release in the middle and upper furnace 10 zones as will be shown later.

The liquid-coal slurry is injected through a central inlet 22 of the atomizer 18 into a diverging exhaust nozzle 24. Natural gas from the annular inlet 20 mixes with the coal water slurry, or CWS, through openings 26. The mixture is injected into the end cap 25 of the atomizer through the diverging nozzle 24 according to the predetermined ratio described earlier. The mixture is atomized through holes in the end cap 25 into the reburn zone 16. This co-firing of CWS and natural gas in the reburn zone 16 achieved $NO_x$ reductions in-line with those obtained using natural gas alone but at a significant cost reduction due to the lower cost of the CWS fuel.

Figure 2B:
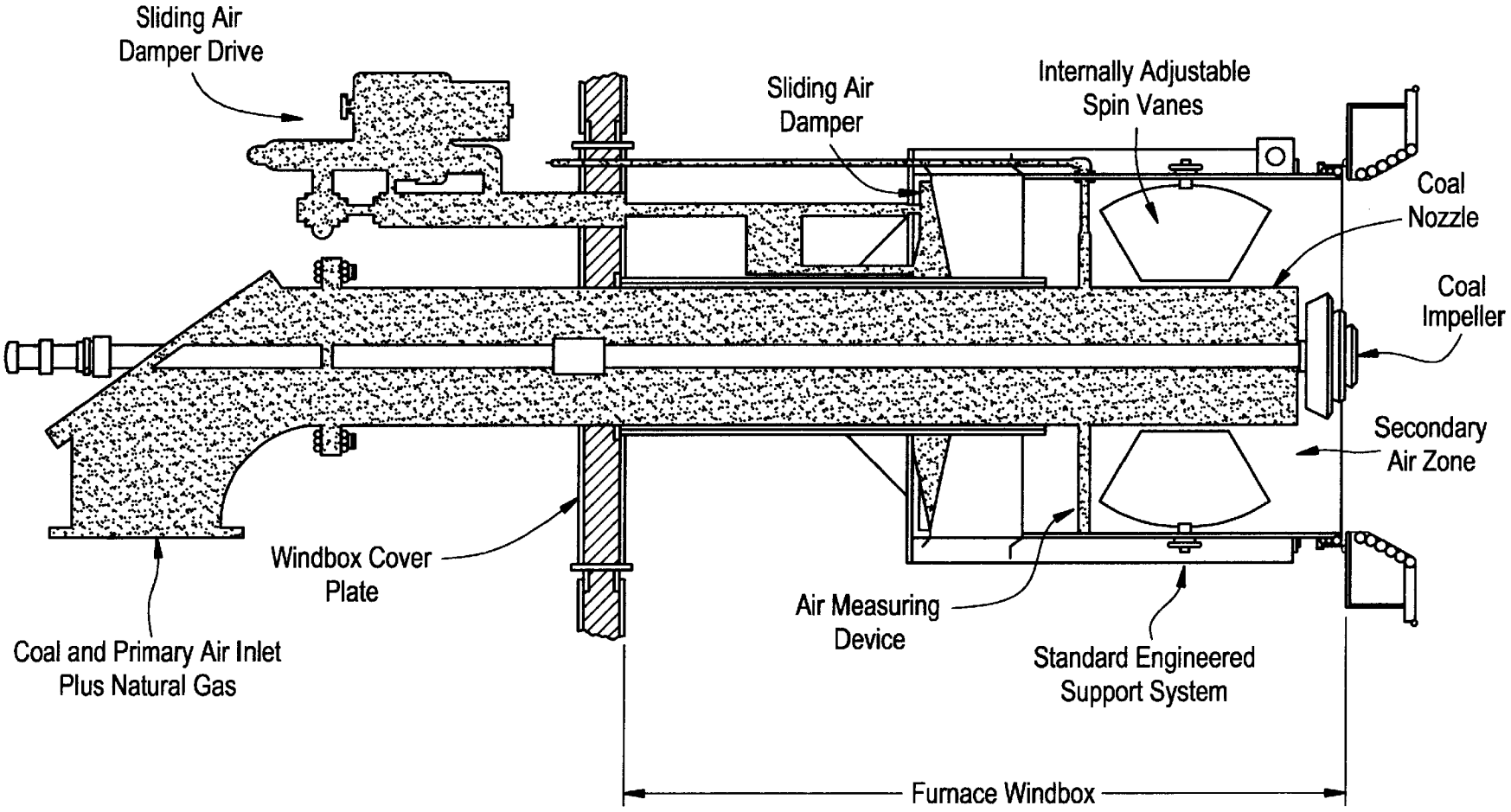
FIG. 2B is a cut away side view of an alternative co-firing burner for solid fuels, such as coal, in the reburn zone of FIG. 1.

In the case of a solid fuel such as coal, FIG. 2B shows the coal, primary transport air, and natural gas introduced together through the coal nozzle of a traditional pulverized coal burner. Here the natural gas serves as both supplementary reburn fuel and as a transport medium for the pulverized coal. Depending upon the gas flow needed to transport the coal, natural gas could serve as the only transport medium in some applications.

Typically, reburning with natural gas gives better results than obtained by using oil, coal, or CWS as the reburn fuel. The advantage of the present invention is the potential for $NO_x$ removals while reburning with coal or CWS as the primary reburn fuel (supplemented by natural gas) as good as those obtained by using natural gas as the only reburn fuel. Testing showed removal of 12 to 17 percent of the remaining $NO_x$ with about 35 percent of the reburn load supplied by natural gas compared to baseline data with CWS only. These same tests showed more uniform furnace temperatures when the natural gas was used to supplement the reburn fuel.

The above described invention was tested at the Small Boiler Simulator (SBS) Facility at the Babcock & Wilcox Alliance Research Center. The SBS is a 6 million Btu/hr pilot facility designed to simulate operation of full-scale boilers. The facility was operated with coal-water slurry as both the primary and reburn fuels, and natural gas was used as the supplementary fuel for the reburning zone. Natural gas was introduced to the combustion zone by three methods; mixed with the reburn combustion air, as the atomizing medium for the reburn coal-water slurry, and mixed with the overfire air. In addition, the natural gas was introduced at three different flow rates in the reburn combustion air to evaluate the effect of different gas/coal-water slurry concentrations on $NO_x$ reduction. In each case, the amount of coal-water slurry used for reburning was varied so that the net fuel load (slurry+gas) at the reburn zone remained the same.

Stack emissions ($SO_2$, $NO_x$, CO, $CO_2$, and $O_2$) were monitored continuously, and the concentrations and all pertinent operating parameters were monitored with a data acquisition system. In addition, temperature traverses were made of the upper furnace at points indicated in FIG. 3 to determine the effect on the temperature profile across the furnace. Dust loadings were also performed to determine if gas co-burning affects fly ash properties.

A summary of the test results are given in Table 1. For each test condition, a description of the test, natural gas and slurry flow rates, flue gas concentrations, and percent of reburning load as natural gas is given. The unburned carbon in the fly ash is also given for the tests in which dust loadings were performed. As can be seen, a reduction in $NO_x$ emissions of approximately 50 ppm, or 12 percent, was observed when natural gas was added to the reburn combustion air, when compared to reburning with coal-water slurry alone. When natural gas was used-as the atomizing medium for the reburn coal-water slurry, a reduction of approximately 70 ppm, or 17 percent, was observed. In addition, visual observations of the reburn zone indicated that the reburn flame had a softer, more uniform appearance than for the tests conducted with natural gas addition in the reburn zone, although this may have been due to the difference in pressure between the natural gas and compressed air (40 psig v 100 psig).

Variations in the natural gas/coal-water slurry ratio in the reburn zone were made to determine its effect on $NO_x$ reduction performance. These tests were performed with natural gas introduced with the reburn combustion air. No trend was apparent, as the data ranged from slightly below (369 ppm v. 415 ppm) to above (432 and 496 ppm v. 415 ppm) the value for coal-water slurry alone.

Finally, a test was performed with the natural gas addition in the overfire air zone 28 of the furnace 10 best seen in FIG. 1. This resulted in a noticeably higher $NO_x$ concentration. This was most likely due to (1) the reduced fuel rate to the reburn zone, and (2) the overfire zone being sufficiently far away from the reburn zone so as to minimize any stabilizing effect the natural gas may have had. This last observation is based on the physical appearance of the reburn flame, which was similar to that for coal-water slurry reburn with no natural gas addition.

Figure 3:
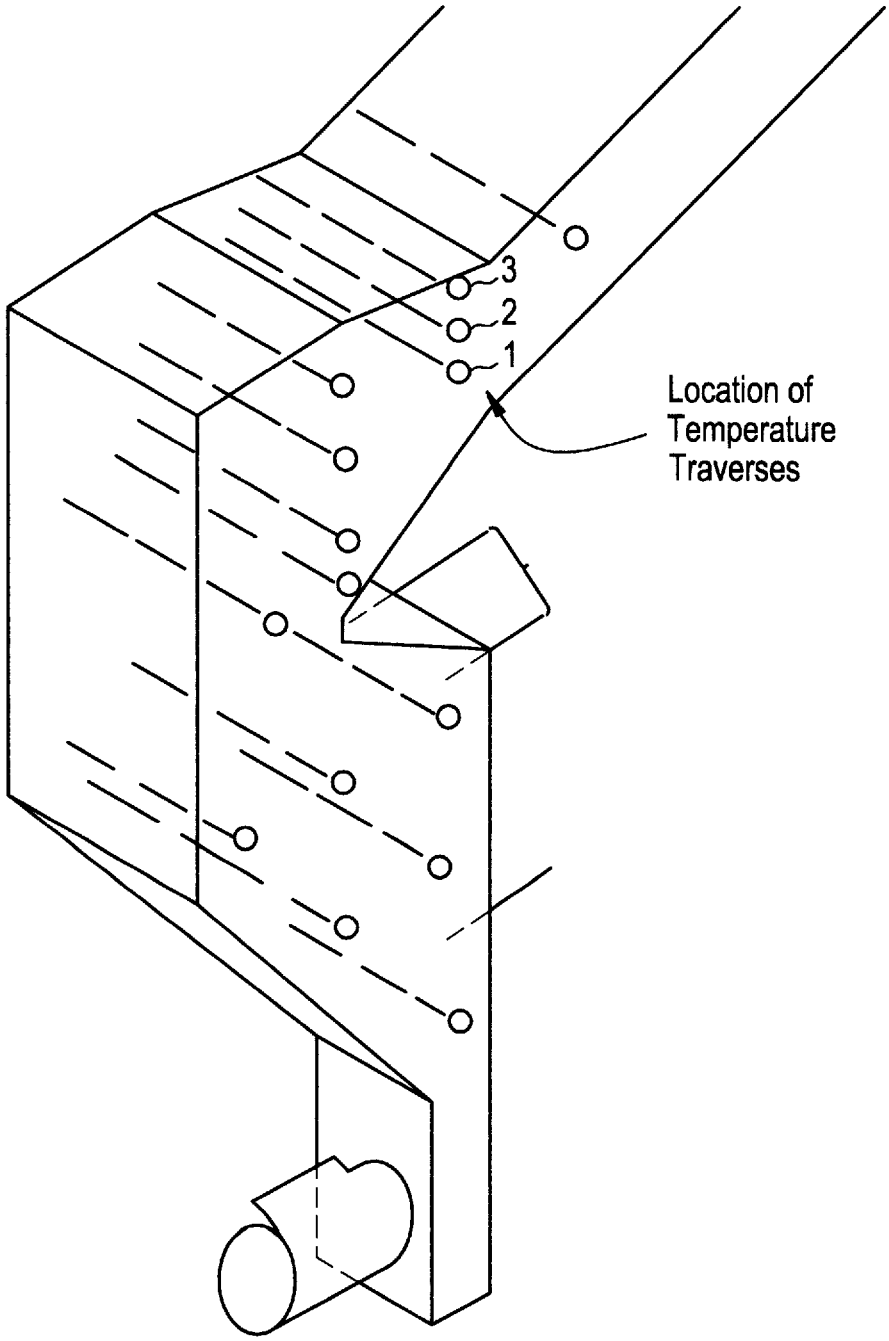
FIG. 3 is an isometric view of FIG. 1 flue detailing the temperature measurement points made therein.

Temperature traverses of the convective pass of the SBS were made at points shown in FIG. 3 during two of the tests to evaluate the effect of natural gas stabilization on the temperature profile within the duct. The data from these traverses are summarized in Table I. As mentioned previously, a potential benefit of gas stabilization is a more uniform heat release in the middle and upper furnace zones. Temperature measurements were taken at each point in a 3×3 matrix, three points each for the top, middle, and bottom sections of the duct. FIG. 3 shows the relative location of the temperature measurements.

Figure 4:
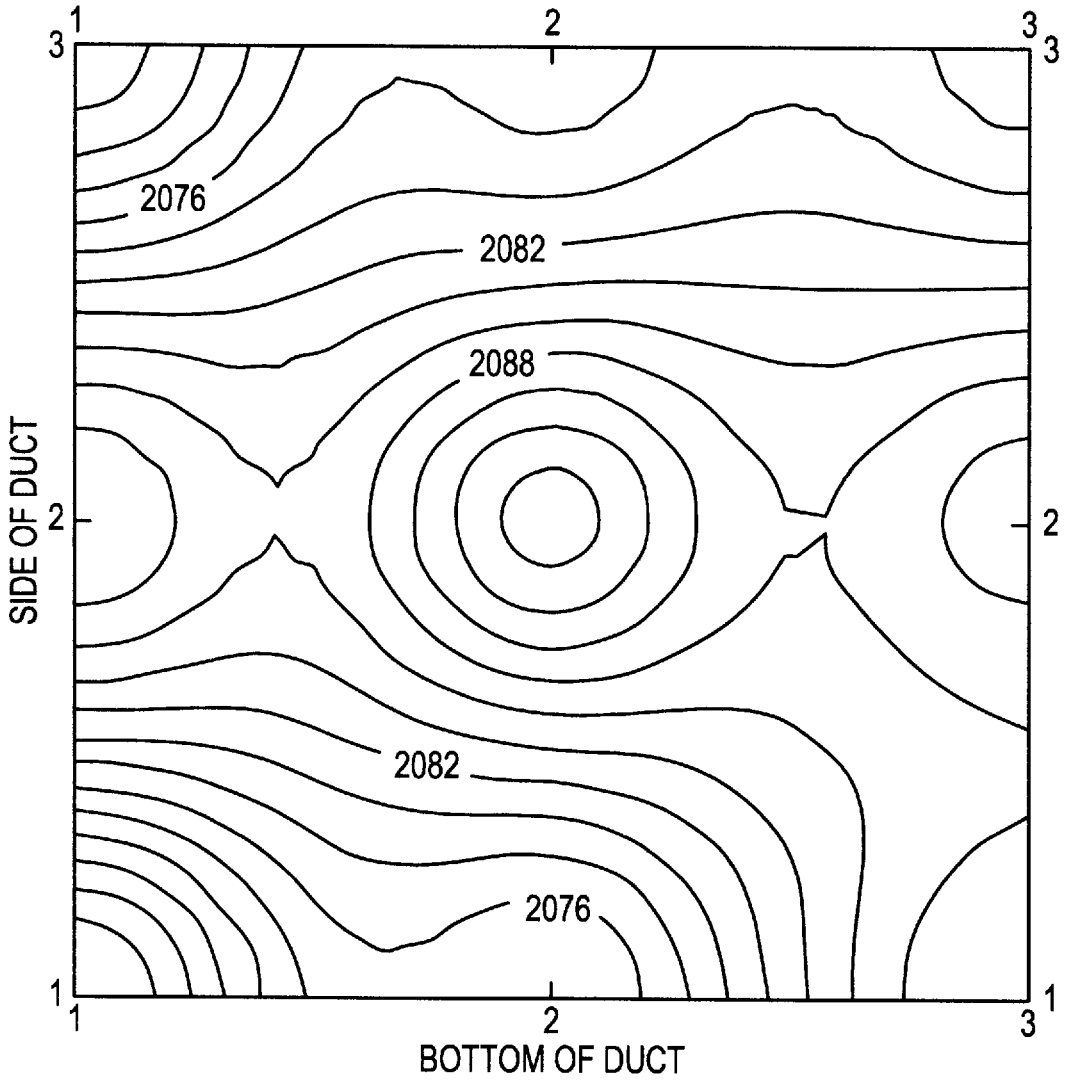
FIG. 4 is a flue temperature profile for FIG. 3 duct using natural gas atomization of coal-water slurry fuel.
Figure 5:
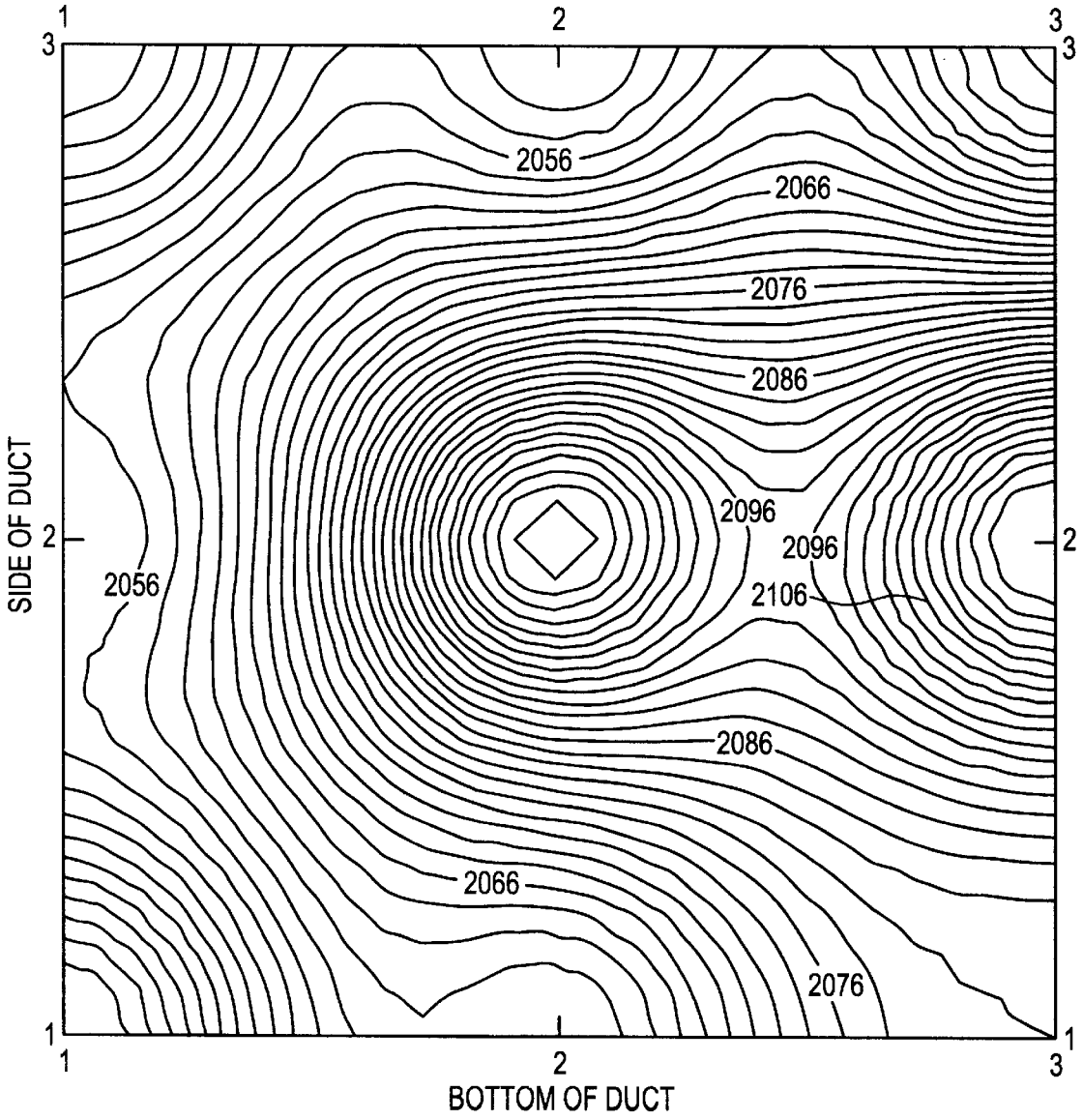
FIG. 5 is a flue temperature profile for FIG. 3 duct using natural gas injection into the overfire air rather than in CWS atomization.
Figure 6:
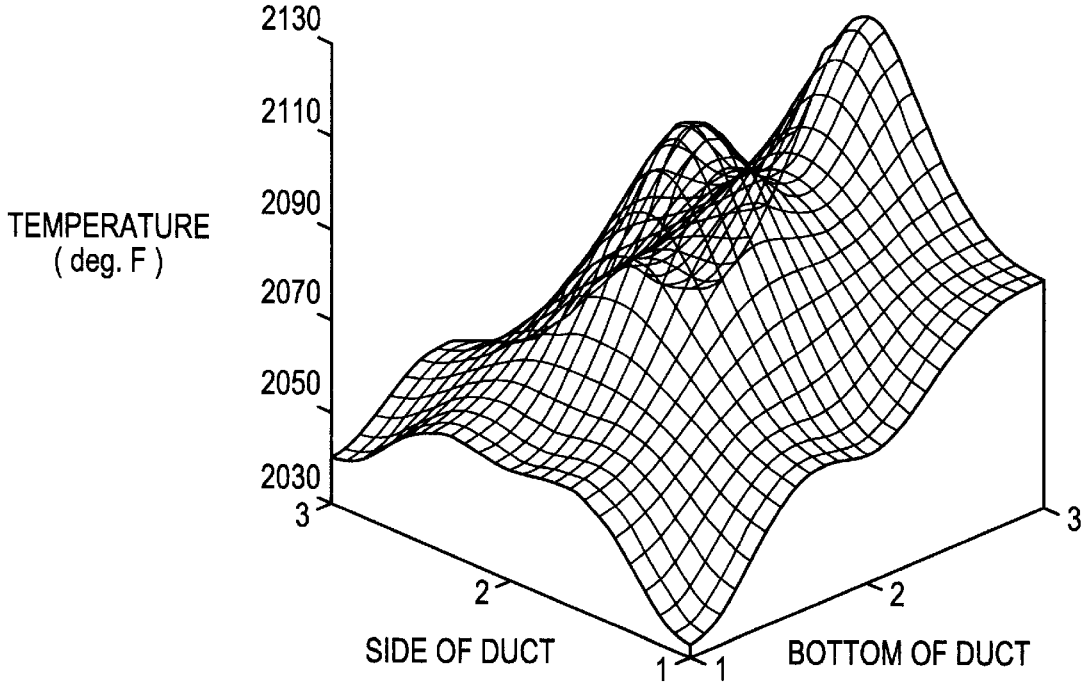
FIG. 6 is a flue temperature three dimensional graph of FIG. 5.
Figure 7:
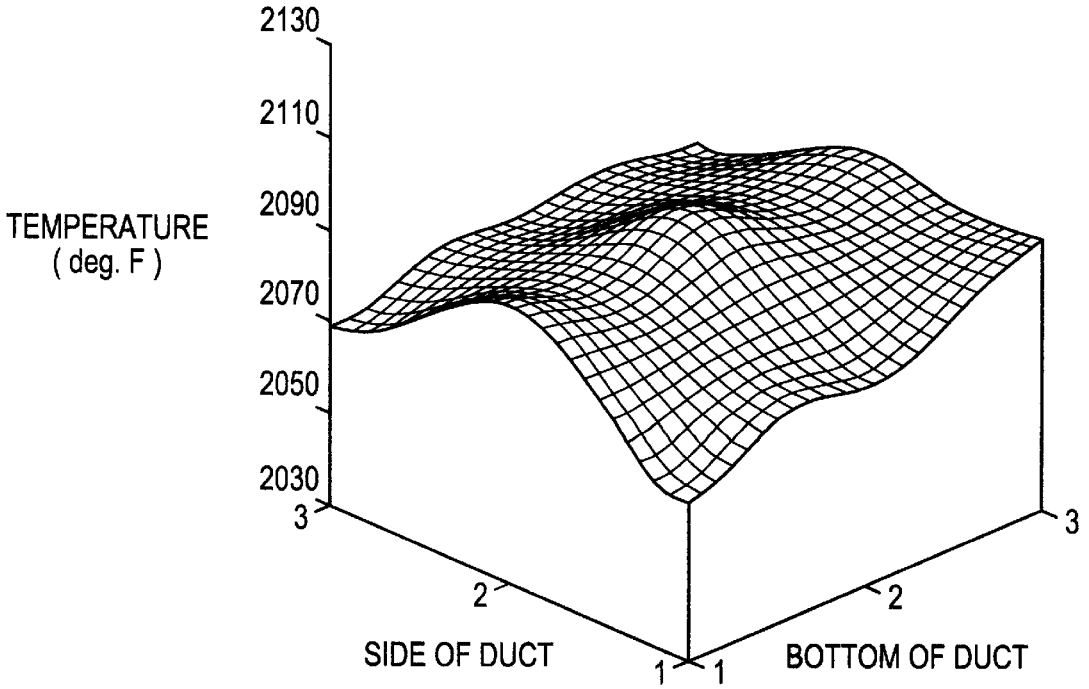
FIG. 7 is a flue temperature three dimensional graph of FIG. 4.

In FIGS. 4 and 5, temperature profiles for natural gas atomization and for overfire air addition are shown, respectively. In each plot, the X and Y axes represent the number of the measurement (1, 2, or 3) and not a dimensional measurement of the duct. The data were reduced using a commercially available SURFER software package. SURFER generates 2- and 3- dimensional plots through various interpolative methods. The inverse distance method was used to interpolate the temperature traverse data. Inverse distance uses a weighted averaging technique to interpolate grid node, and data points further away from a given grid node will have less influence on the generated plot. A grid size of 25×25 was used to interpolate the data. The temperature difference between consecutive contours is 2° F. As can be seen, the temperature profile for natural gas atomization shown in FIG. 4 is much more uniform than that for overfire air addition shown in FIG. 5. As mentioned previously, the addition of natural gas to the overfire air did not noticeably affect reburn flame stability. As a result, the temperature profile for the overfire air test is probably similar in appearance to that for reburn with coal-water slurry alone. In FIGS. 6 and 7, the data for the two tests are shown as surfaces. Again, it can be seen that the addition of natural gas results in a more uniform temperature profile.

Certain additions and modifications have been deleted herein for the sake of conciseness and readability but it will be understood that all such are intended to be within the scope of the following claims.

What is claimed is:

1. An improved combustion system for the reburn zone of a boiler for reduced $NO_x$ combustion by the boiler, the boiler having a primary firing zone with the reburn zone being situated downstream therefrom, comprising:

an atomizer having a central opening therein for conveying a liquid fuel for combustion in the reburn zone of the boiler, said atomizer having a diverging nozzle outlet communicating with the reburn zone of the boiler through an end cap; and an annular opening around said central opening of said atomizer connected to said central opening through a plurality of holes near said diverging nozzle outlet for delivering natural gas to said diverging nozzle outlet along with said liquid fuel and exhausting the mixture through said end cap into the reburn zone of the boiler for combustion in the reburn zone of the boiler.

2. An improved combustion system as set forth in claim 1, wherein said liquid fuel is a coal-water slurry.

3. An improved combustion system as set forth in claim 2 wherein said diverging nozzle delivers a mixture of coal-water slurry and natural gas to said reburn zone in a four to one ratio by weight of coal water slurry to natural gas.

4. A method of reducing $NO_x$ emission from a boiler exhaust from a primary firing zone using reburn combustion of liquid fuel downstream therefrom, comprising the steps of:

conveying a liquid fuel for combustion through a central opening of an atomizer having a diverging nozzle outlet with an end cap;

atomizing the liquid fuel with the addition of natural gas by way of an annular opening around the central opening of the atomizer through a plurality of holes near the diverging nozzle outlet;

delivering natural gas along with the liquid fuel through the end cap into the reburn zone of the boiler; and combusting the atomized mixture in the reburn zone of the boiler to provide $NO_x$ reductions comparable to those found with the sole combustion of natural gas in the reburn zone of the boiler.

5. A method as set forth in claim 4 wherein the liquid fuel injected into the reburn zone is a coal-water slurry.

6. A method as set forth in claim 5 wherein the coal-water slurry to atomizing natural gas is injected into the reburn zone in a ratio of approximately four to one by weight of coal-water slurry to natural gas.

7. An atomizer for injecting a mixture of coal-water slurry and natural gas into the reburn zone of a boiler downstream from the primary firing zone, comprising:

a central opening formed along the atomizer connected to a source of coal-water slurry;

a diverging nozzle outlet connected to said central opening for exhausting into the reburn zone of the boiler through an end cap;

an annular opening formed around said formed central opening connected to a source of natural gas; and a plurality of openings formed near said diverging nozzle outlet connecting said central opening to said annular opening to deliver the flow of both the coal-water slurry and the natural gas into said diverging nozzle outlet and into the reburn zone through said end cap, said coal-liquid slurry and natural gas flow from said diverging nozzle outlet through said end cap into the reburn zone in a ratio of approximately four to one by weight of coal water slurry to natural gas.

8. An improved combustion system for the reburn zone of a boiler for reduced $NO_x$ formation by the boiler, the boiler having a primary firing zone with the reburn zone being located downstream therefrom, comprising:

an injector having a central opening therein for conveying a solid fuel to a diverging nozzle outlet into the reburn zone of the boiler for combustion therein; and means for injecting natural gas into the reburn zone of the boiler along with the solid fuel to be mixed with the solid fuel for combustion in the reburn zone of the boiler, said means for injecting natural gas including means for providing the natural gas as a transport medium for the solid fuel.

9. An improved combustion system as set forth in claim 8 wherein said solid fuel is a pulverized coal.

10. An improved combustion system as set forth in claim 8 wherein said solid fuel is a micronized coal.

* * * * *